US010643512B2

(12) United States Patent
Lee et al.

(10) Patent No.: US 10,643,512 B2
(45) Date of Patent: May 5, 2020

(54) DISPLAY DEVICE AND CONTROL METHOD THEREOF

(71) Applicant: SAMSUNG DISPLAY CO., LTD., Yongin-si, Gyeonggi-do (KR)

(72) Inventors: Dae Sik Lee, Yongin-si (KR); Jong Jae Lee, Yongin-si (KR); Su Jin Kim, Yongin-si (KR); Yang Uk Nam, Yongin-si (KR)

(73) Assignee: SAMSUNG DISPLAY CO., LTD., Gyeonggi-Do (KR)

( * ) Notice: Subject to any disclaimer, the term of this patent is extended or adjusted under 35 U.S.C. 154(b) by 157 days.

(21) Appl. No.: 15/791,479

(22) Filed: Oct. 24, 2017

(65) Prior Publication Data

US 2018/0197446 A1 Jul. 12, 2018

(30) Foreign Application Priority Data

Jan. 9, 2017 (KR) ..... 10-2017-0002891

(51) Int. Cl.
*G09G 3/00* (2006.01)
*G09G 3/36* (2006.01)

(52) U.S. Cl.
CPC ..... *G09G 3/006* (2013.01); *G09G 3/3677* (2013.01); *G09G 3/3688* (2013.01); *G09G 3/3696* (2013.01); *G09G 2330/021* (2013.01); *G09G 2330/08* (2013.01); *G09G 2330/12* (2013.01)

(58) Field of Classification Search
CPC .... G09G 3/006; G09G 3/3677; G09G 3/3688; G09G 3/3696; G09G 2330/021; G09G 2330/12
See application file for complete search history.

(56) References Cited

U.S. PATENT DOCUMENTS

| | | | | |
|---|---|---|---|---|
| 7,542,021 | B2 | 6/2009 | Kim et al. | |
| 7,821,512 | B2 | 10/2010 | Yi | |
| 9,601,077 | B2 | 3/2017 | Lim et al. | |
| 2006/0050042 | A1* | 3/2006 | Yi | G09G 3/3696 345/98 |
| 2010/0019749 | A1* | 1/2010 | Katsuya | H02M 1/15 323/282 |
| 2010/0110058 | A1* | 5/2010 | Moh | G09G 3/3655 345/211 |
| 2013/0314606 | A1* | 11/2013 | Murakami | G05F 1/618 348/730 |
| 2014/0015741 | A1* | 1/2014 | Wang | G09G 3/3611 345/88 |
| 2018/0033384 | A1* | 2/2018 | Kim | G09G 3/3614 |

FOREIGN PATENT DOCUMENTS

| | | | |
|---|---|---|---|
| KR | 1020080062926 | A | 7/2008 |
| KR | 101056373 | B1 | 8/2011 |
| KR | 101157837 | B1 | 6/2012 |
| KR | 1020150022457 | A | 3/2015 |

* cited by examiner

*Primary Examiner* — Dmitriy Bolotin
(74) *Attorney, Agent, or Firm* — Cantor Colburn LLP

(57) ABSTRACT

A display device includes a display unit, a driving voltage supply unit which supplies a driving voltage to the display unit, a ripple detection circuit which detects the number of times a ripple of the driving voltage is generated, and a controller which controls the driving voltage supply unit so as to change the driving voltage based on the number of times the ripple is generated.

20 Claims, 6 Drawing Sheets

DISPLAY DEVICE AND CONTROL METHOD THEREOF

DISPLAY DEVICE AND CONTROL METHOD THEREOF

This application claims priority to Korean Patent Application No. 10-2017-0002891, filed on Jan. 9, 2017, and all the benefits accruing therefrom under 35 U.S.C. § 119, the content of which in its entirety is herein incorporated by reference.

BACKGROUND

1. Field

Exemplary embodiments of the invention relate to a display device, and a control method thereof.

2. Description of the Related Art

A liquid crystal display ("LCD") device includes an LCD unit displaying an image by using light transmittance of a liquid crystal and a backlight assembly, which is disposed in a lower portion of the LCD unit and provides light to the LCD unit.

The LCD unit includes a pixel unit displaying an image, and a data driver and a gate driver driving the pixel unit. The LCD unit may receive a driving voltage from a power supply unit. The driving voltage includes a common voltage supplied to the pixel unit, and a data driving voltage supplied to the data driver.

SUMMARY

A driving voltage may include a ripple according to an image displayed on a liquid crystal display ("LCD") unit and a physical characteristic of the LCD unit. A display quality may be degraded and current consumption may be increased by the ripple of the driving voltage.

An exemplary embodiment of the invention provides a display device, including a display unit, a driving voltage supply unit which supplies a driving voltage to the display unit, a ripple detection circuit which detects a number of times a ripple of the driving voltage is generated, and a controller which controls the driving voltage supply unit so as to change the driving voltage based on the number of times the ripple is generated.

In an exemplary embodiment, the ripple detection circuit may count the number of times the ripple is generated when a size of the ripple of the driving voltage is equal to or larger than a reference level.

In an exemplary embodiment, when the number of times the ripple is generated for one frame is equal to or larger than a reference value, the controller may control the driving voltage supply unit so as to decrease the driving voltage.

In an exemplary embodiment, the ripple detection circuit may provide ripple data for the size of the ripple and the number of times the ripple is generated to the controller.

In an exemplary embodiment, the controller may differentially change the driving voltage according to the size of the ripple and the number of times the ripple is generated.

In an exemplary embodiment, when the size of the ripple is equal to or larger than a high reference level, the controller may control the driving voltage supply unit so as to change a voltage level of the driving voltage to a predetermined compensation voltage level, when the size of the ripple is equal to or less than a low reference level, which is less than the high reference level, the controller may control the driving voltage supply unit so as to change the voltage level of the driving voltage to a predetermined normal voltage level, and when the size of the ripple is less than the high reference level and exceeds the low reference level, the controller may control the driving voltage supply unit so as to maintain the voltage level of the driving voltage.

In an exemplary embodiment, the compensation voltage level may be less than the normal voltage level.

In an exemplary embodiment, the ripple detection circuit may count the number of times the ripple is generated in a unit of a predetermined time that is a value obtained by dividing one frame into a plurality of unit periods.

In an exemplary embodiment, the controller may average the numbers of times the ripple is generated corresponding to each frame for a plurality of frames and calculate an average number of times the ripple is generated, and when the average number of times the ripple is generated is equal to or larger than a reference value, the controller control the driving voltage supply unit so as to decrease the driving voltage.

In an exemplary embodiment, the ripple detection circuit may include a first comparator, which compares a positive reference voltage with the driving voltage, a second comparator, which compares a negative reference voltage with the driving voltage, a first counter, which counts a result value of the first comparator, and a second counter, which counts a result value of the second comparator.

In an exemplary embodiment, the ripple detection circuit may receive the driving voltage through a feedback line.

In an exemplary embodiment, the display unit may include a pixel unit including a plurality of pixels connected with gate lines and data lines, a gate driver, which supplies gate signals through the gate lines, and a data driver, which supplies data signals through the data lines.

In an exemplary embodiment, the driving voltage may include at least one of a common voltage supplied to the pixel unit and a data driving voltage supplied to the data driver.

Another exemplary embodiment of the invention provides a method of controlling a display device, the method including supplying a driving voltage to a display unit, detecting a number of times a ripple of the driving voltage is generated, and changing the driving voltage based on the number of times the ripple is generated.

In an exemplary embodiment, the detecting the number of times the ripple is generated may include counting the number of times the ripple is generated when a size of the ripple of the driving voltage is equal to or larger than a reference level.

In an exemplary embodiment, the changing the driving voltage may include decreasing the driving voltage when the number of times the ripple is generated for one frame is equal to or larger than a reference value.

In an exemplary embodiment, the changing the driving voltage may include changing a voltage level of the driving voltage to a predetermined compensation voltage level when a size of the ripple is equal to or larger than a high reference level, when the size of the ripple is equal to or less than a low reference level, which is less than the high reference level, changing the voltage level of the driving voltage to a predetermined normal voltage level, and when the size of the ripple is less than the high reference level and exceeds the low reference level, maintaining the voltage level of the driving voltage.

In an exemplary embodiment, the compensation voltage level may be less than the normal voltage level.

In an exemplary embodiment, the detecting the number of times the ripple is generated may include counting the number of times the ripple is generated in a unit of a predetermined time that is a value obtained by dividing one frame into a plurality of unit periods.

In an exemplary embodiment, the changing the driving voltage may include averaging the numbers of times the ripple is generated corresponding to each frame for a plurality of frames and calculating an average number of times the ripple is generated, and decreasing the driving voltage when the average number of times the ripple is generated is equal to or larger than a reference value.

BRIEF DESCRIPTION OF THE DRAWINGS

Exemplary embodiments will now be described more fully hereinafter with reference to the accompanying drawings, in which.

DETAILED DESCRIPTION

Figure 1:
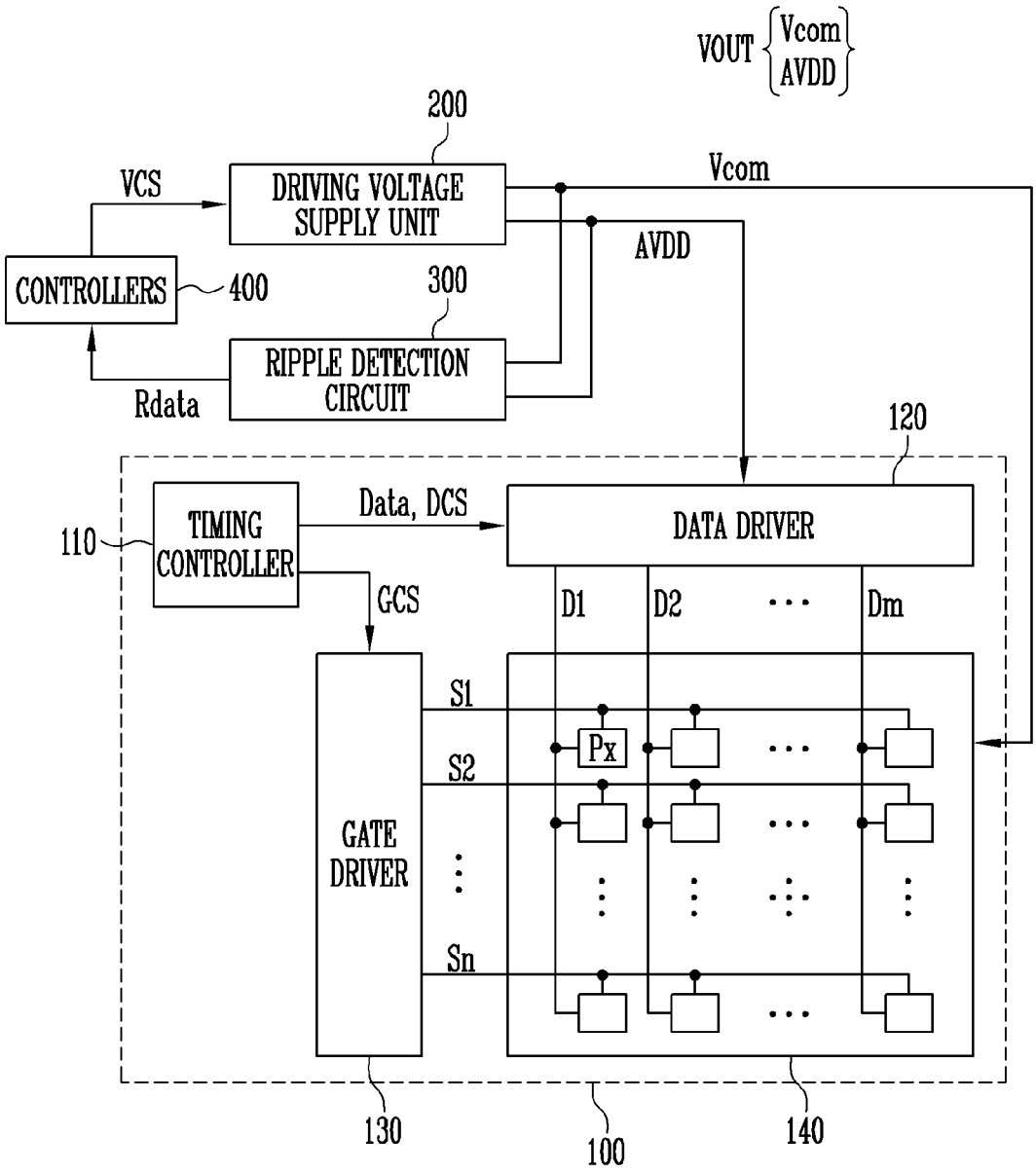
FIG. 1 is a diagram illustrating a display device according to an exemplary embodiment of the invention.

The disclosure may be variously modified and have various forms, so that specific exemplary embodiments will be illustrated in the drawings and described in detail in the text. However it should be understood that the invention is not limited to the specific embodiments, but includes all changes, equivalents, or alternatives which are included in the spirit and technical scope of the disclosure.

In the description of respective drawings, similar reference numerals designate similar elements. In the accompanying drawings, sizes of structures are illustrated to be enlarged compared to actual sizes for clarity of the disclosure. Terms "first", "second", and the like may be used for describing various constituent elements, but the constituent elements should not be limited to the terms. The terms are used only to discriminate one constituent element from another constituent element. For example, a first element could be termed a second element, and similarly, a second element could be also termed a first element without departing from the scope of the invention. As used herein, the singular forms are intended to include the plural forms as well, unless the context clearly indicates otherwise.

In the disclosure, it should be understood that terms "include" or "have" indicates that a feature, a number, a step, an operation, a component, a part or the combination those of described in the specification is present, but do not exclude a possibility of presence or addition of one or more other features, numbers, steps, operations, components, parts or combinations, in advance. It will be understood that when an element such as a layer, film, region, or substrate is referred to as being "on" another element, it can be directly on the other element or intervening elements may also be present. Further, in the disclosure, when a part of a layer, a film, an area, a plate, and the like is formed on another part, a direction, in which the part is formed, is not limited only to an up direction, and includes a lateral direction or a down direction. On the contrary, it will be understood that when an element such as a layer, film, region, or substrate is referred to as being "beneath" another element, it can be directly beneath the other element or intervening elements may also be present.

It will be understood that when an element is referred to as being "between" two elements, it can be the only element between the two elements, or one or more intervening elements may also be present. Like reference numerals refer to like elements throughout.

The terminology used herein is for the purpose of describing particular embodiments only and is not intended to be limiting. As used herein, the singular forms "a," "an," and "the" are intended to include the plural forms, including "at least one," unless the content clearly indicates otherwise. "Or" means "and/or." As used herein, the term "and/or" includes any and all combinations of one or more of the associated listed items. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. In an exemplary embodiment, when the device in one of the figures is turned over, elements described as being on the "lower" side of other elements would then be oriented on "upper" sides of the other elements. The exemplary term "lower," can therefore, encompasses both an orientation of "lower" and "upper," depending on the particular orientation of the figure. Similarly, when the device in one of the figures is turned over, elements described as "below" or "beneath" other elements would then be oriented "above" the other elements. The exemplary terms "below" or "beneath" can, therefore, encompass both an orientation of above and below.

"About" or "approximately" as used herein is inclusive of the stated value and means within an acceptable range of deviation for the particular value as determined by one of ordinary skill in the art, considering the measurement in question and the error associated with measurement of the particular quantity (i.e., the limitations of the measurement system). For example, "about" can mean within one or more standard deviations, or within ±30%, 20%, 10%, 5% of the stated value.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and the invention, and will not be interpreted in an idealized or overly formal sense unless expressly so defined herein.

Exemplary embodiments are described herein with reference to cross section illustrations that are schematic illustrations of idealized embodiments. As such, variations from the shapes of the illustrations as a result, for example, of manufacturing techniques and/or tolerances, are to be expected. Thus, embodiments described herein should not be construed as limited to the particular shapes of regions as illustrated herein but are to include deviations in shapes that result, for example, from manufacturing. In an exemplary embodiment, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the claims.

Hereinafter, an exemplary embodiment of the invention will be described in detail in more detail with reference to the accompanying drawings.

FIG. 1 is a diagram illustrating a display device according to an exemplary embodiment of the invention.

Referring to FIG. 1, a display device according to an exemplary embodiment of the invention includes a display unit 100, a driving voltage supplying unit 200, a ripple detecting circuit 300, and a controller 400.

The display unit 100 may include a timing controller 110, a data driver 120, a gate driver 130, and a pixel unit 140.

The timing controller 110 receives image data, and synchronization signal, a clock signal, and the like for controlling a display of the image data. The timing controller 110 corrects the input image data so as to be appropriate to an image display of the pixel unit 140, and supplies a corrected data signal Data to the data driver 120. Further, the timing controller 110 outputs a data control signal DCS for controlling an operation timing of the data driver 120, and a gate control signal GCS for controlling an operation timing of the gate driver 130.

The data driver 120 is connected with data lines D1 to Dm (where m is a natural number), and supplies a data signal to the pixel unit 140 through the data lines D1 to Dm. The data driver 120 converts the data signal Data in the digital form supplied from the timing controller 110 into a data signal (or voltage) in the analog form. In an exemplary embodiment, the data driver 120 outputs a gray voltage corresponding to the data signal Data in response to the data control signal DCS of the timing controller 110.

In the exemplary embodiment, the data driver 120 may include a gamma circuit (not illustrated), and the gamma circuit may generate gamma reference voltages based on a data driving voltage AVDD supplied from the driving voltage supplying unit 200. Further, the data driver 120 divides the gamma reference voltages and generates gray voltages.

The gate driver 130 is connected with gate lines S1 to Sn (where n is a natural number), and supplies a gate signal to the pixel unit 140 through the gate lines S1 to Sn. Particularly, the gate driver 130 outputs the gate signal while shifting a level of a gate voltage in response to the gate control signal GCS of the timing controller 110. In the exemplary embodiment, the gate driver 130 may include a plurality of stage circuits, and may sequentially supply the gate signals to the gate lines S1 to Sn.

The pixel unit 140 displays an image in response to the data signal supplied from the data driver 120 and the gate signal supplied from the gate driver 130. The pixel unit 140 includes a plurality of pixels Px, which is connected to the gate lines S1 to Sn and the data lines D1 to Dm, and is arranged in a matrix form.

Particularly, the pixels Px are selected in the unit of a horizontal line in response to the gate signal supplied to any one of the gate lines S1 to Sn. In this case, each of the pixels Px selected by the gate signal receives the data signal from the data line (any one of the data lines D1 to Dm) connected to the pixel Px. Each of the pixels Px receiving the data signal emits light with predetermined luminance corresponding to the data signal.

In an exemplary embodiment, the pixel unit 140 may be a liquid crystal display ("LCD") panel, but is not limited thereto, and may be various other types of panels, such as an organic electroluminescent display panel.

In the exemplary embodiment, the pixel unit 140 may provide a common voltage Vcom supplied from the driving voltage supplying unit 200 to the pixels Px.

The driving voltage supplying unit 200 supplies a driving voltage VOUT to the display unit 100. The driving voltage VOUT may include at least one of the common voltage Vcom supplied to the pixel unit 140 and a data driving voltage AVDD provided to the data driver 120. Further, the driving voltage VOUT may further include a gate on voltage and a gate off voltage provided to the gate driver 130.

The driving voltage supplying unit 200 may increase or decrease a voltage level of the driving voltage VOUT in response to a driving voltage control signal VCS of the controller 400 and output the driving voltage VOUT. The driving voltage supply unit 200 may include at least one of a direct current to direct current ("DC-DC") converter (not illustrated) and an amplifier (not illustrated), and in addition, the driving voltage supply unit 200 may also include other circuits, which are capable of generating the driving voltage VOUT and changing a voltage level of the driving voltage VOUT.

The ripple detecting circuit 300 detects the number of times a ripple of the driving voltage VOUT is generated. To this end, the ripple detection circuit 300 may receive a feedback of the driving voltage VOUT. The ripple detection circuit 300 may be connected to each of output voltage lines of the driving voltage supply unit 200.

In the exemplary embodiment, the ripple detection circuit 300 may count the number of times the ripple is generated when a size of the ripple of the driving voltage VOUT is equal to or larger than a reference level. The reference level of the size of the ripple is a value predetermined according to a load characteristic of the display unit 100. In an exemplary embodiment, the reference level may be about 0.4 volts (V) to about 1.4 V, for example.

The ripple detection circuit 300 may provide ripple data Rdata including information about the size of the ripple and the number of times the ripple is generated to the controller 400. In an exemplary embodiment, the ripple detection circuit 300 may be unitary with at least one of the driving voltage supply unit 200 and the controller 400. The ripple detection circuit 300 will be described in detail below with reference to FIG. 2.

The controller 400 has a structure which enables performing a control operation for compensating for the ripple of the driving voltage VOUT, and controls the driving voltage supply unit 200 so as to change the driving voltage VOUT based on the number of times the ripple is generated. The controller 400 may generate and output the driving voltage control signal VCS for controlling the driving voltage supply unit 200.

In the exemplary embodiment, when the number of times the ripple is generated is equal to or larger than a reference value for one frame, the controller 400 may control the driving voltage supply unit 200 so as to decrease the driving voltage VOUT. In an exemplary embodiment, when the number of times the ripple is generated is equal to or larger than 3 for one frame, the controller 400 may control the driving voltage supply unit 200 so as to decrease the driving voltage VOUT to a level of about 80 percent (%), for example. When the voltage level of the driving voltage VOUT is decreased, the size of the ripple is also decreased.

In the exemplary embodiment, the controller 400 may differentially change the driving voltage VOUT according to the size of the ripple and the number of times the ripple is generated. The controller 400 may determine the size of the ripple and the number of times the ripple is generated from the ripple data Rdata provided from the ripple detection circuit 300. In an exemplary embodiment, when the size of the ripple is about 0.5 volt (V), and the number of times the ripple is generated is 2, the controller 400 may control the driving voltage supply unit 200 so as to decrease the driving voltage VOUT to a level of about 90%, for example. In an exemplary embodiment, when the size of the ripple is about 0.7 V, and the number of times the ripple is generated is 3, the controller 400 may control the driving voltage supply unit 200 so as to decrease the driving voltage VOUT to a level of about 80%, for example.

The controller 400 may be unitary with at least one of the driving voltage supply unit 200, the ripple detection circuit 300, and the timing controller 110. In an exemplary embodiment, the controller 400 may provide information on states of the ripple data Rdata and the driving voltage VOUT to the timing controller 110.

According to the invention, the ripple is compensated by the method of changing the driving voltage based on the number of times the ripple of the driving voltage is generated, thereby more effectively, accurately, and rapidly compensating for the ripple of the driving voltage.

Figure 2:
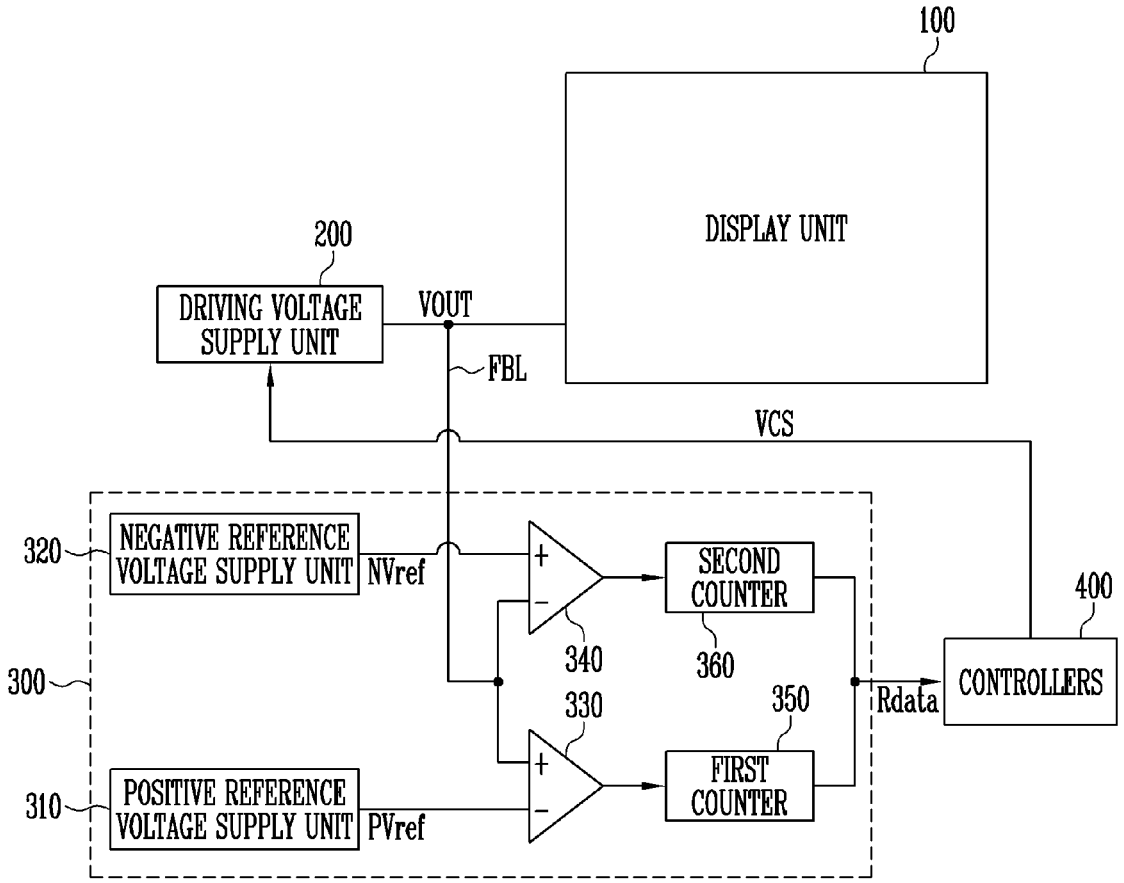
FIG. 2 is a detailed diagram of a ripple detecting circuit illustrated in FIG. 1.
Figure 3:
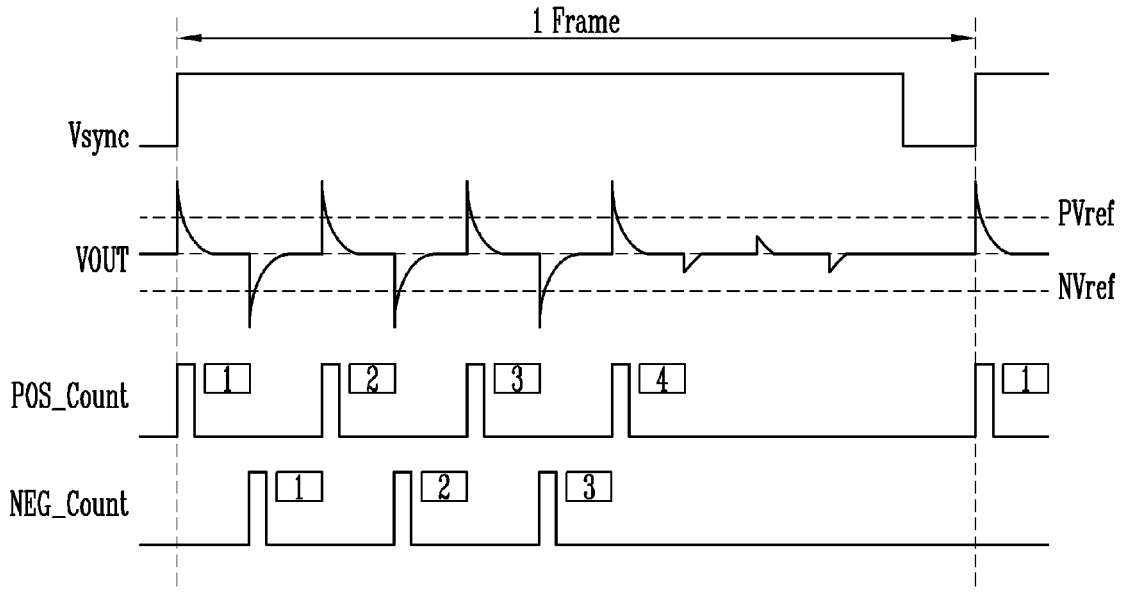
FIG. 3 is a waveform diagram for describing a detection of the number of times a ripple of a driving voltage is generated.

FIG. 2 is a detailed diagram of the ripple detecting circuit illustrated in FIG. 1, and FIG. 3 is a waveform diagram for describing a detection of the number of times the ripple of the driving voltage is generated.

Referring to FIGS. 2 and 3, the ripple detection circuit 300 according to the exemplary embodiment of the invention includes a firs comparator 330 comparing a positive reference voltage PVref and the driving voltage VOUT, a second comparator 340 comparing a negative reference voltage NVref and the driving voltage VOUT, a first counter 350 counting a result value of the first comparator 330, and a second counter 360 counting a result value of the second comparator 340.

The ripple detection circuit 300 receives the driving voltage VOUT through a feedback line FBL. One end of the feedback line FBL may be connected to a supply line of the driving voltage VOUT between the driving voltage supply unit 200 and the display unit 100. The other end of the feedback line FBL may be connected to the first comparator 330 and the second comparator 340.

Further, the ripple detection circuit 300 may further include a positive reference voltage supply unit 310 providing the positive reference voltage PVref, and a negative reference voltage supply unit 320 providing the negative reference voltage NVref.

The first comparator 330 may include an inverting input terminal (−), which is connected with the positive reference voltage supply unit 310 to receive the positive reference voltage PVref, a non-inverting input terminal (+), which is connected with the feedback line FBL and receives the driving voltage VOUT, and an output terminal which outputs a positive ripple generation signal POS_Count when the driving voltage VOUT is higher than the positive reference voltage PVref.

The second comparator 340 may include an inverting input terminal (−), which is connected with the feedback line FBL to receive the driving voltage VOUT, a non-inverting input terminal (+), which is connected with the negative reference voltage supply unit 320 and receives the negative reference voltage NVref, and an output terminal which outputs a negative ripple generation signal NEG_Count when the driving voltage VOUT is higher than the negative reference voltage NVref.

The first counter 350 counts a result value of the first comparator 330 based on the positive ripple generation signal POS_Count in a predetermined period or a predetermined unit and provides information on the number of times of the positive ripple to the controller 400. The second counter 360 counts a result value of the second comparator 340 based on the positive ripple generation signal NEG_Count in a predetermined period or a predetermined unit and provides information on the number of times of the negative ripple to the controller 400.

In an exemplary embodiment, when the driving voltage VOUT is an inversion-driven common voltage Vcom and has a waveform illustrated in FIG. 3, the first comparator 330 outputs the positive ripple generation signal POS_Count of a high level at a timing at which the driving voltage VOUT is higher than the positive reference voltage PVref, for example. In the illustrated exemplary embodiment, the first counter 350 provides ripple data Rdata, which notifies that the positive ripple is generated four times within one frame corresponding to a synchronization signal Vsync, for example, to the controller 400.

Further, the second comparator 340 outputs the negative ripple generation signal NEG_Count of a high level at a timing at which the driving voltage VOUT is less than the negative reference voltage NVref. In the illustrated exemplary embodiment, the second counter 360 provides ripple data Rdata, which notifies that the negative ripple is generated three times within one frame, to the controller 400, for example.

The controller 400 may determine that the ripple is generated a total of seven times within one frame by aggregating the number of times the positive ripple is generated and the number of times the negative ripple is generated. When a reference value of the number of times the ripple is generated for a ripple compensation operation is set to five, the controller 400 may output the driving voltage control signal VCS for decreasing the driving voltage VOUT to control the driving voltage supply unit 200.

However, the ripple detection circuit 300 is not limited to the aforementioned structure, and may be modified to various structures, which are capable of detecting the generation of the ripple of the driving voltage VOUT and counting the number of times the ripple is generated.

Figure 4:
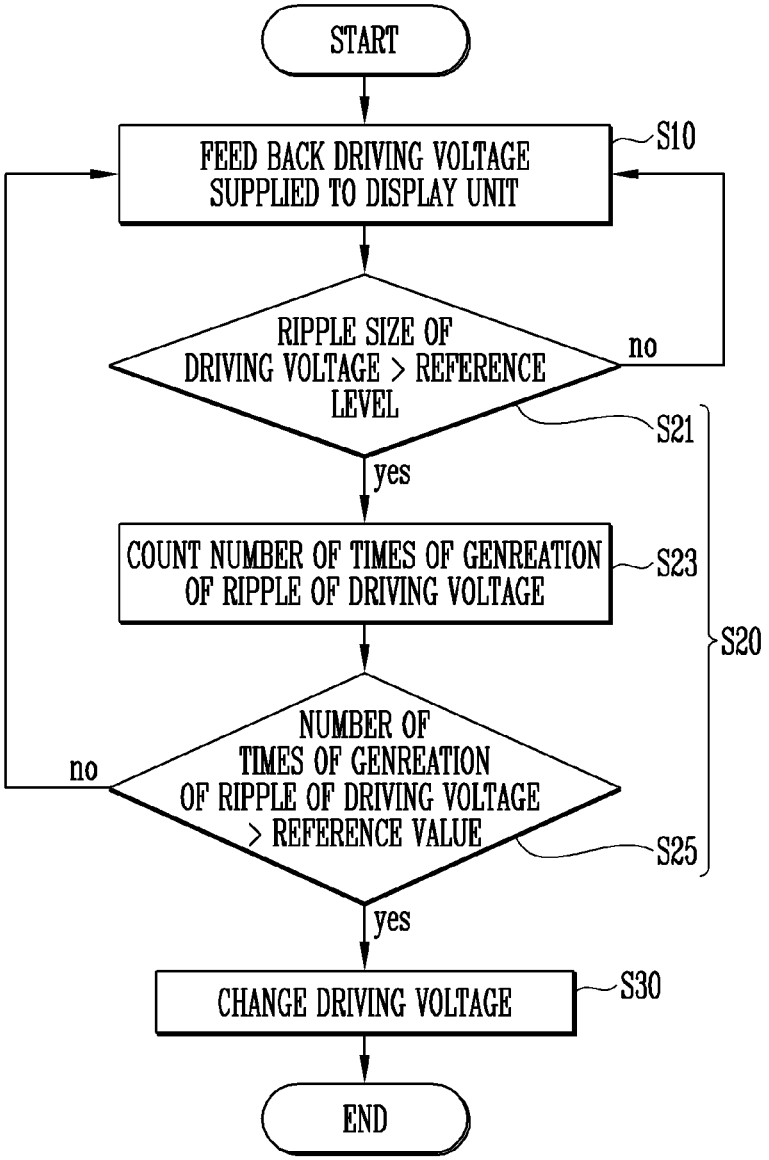
FIG. 4 is a flow chart illustrating a method of controlling a display device according to an exemplary embodiment of the invention.

FIG. 4 is a flow chart illustrating a method of controlling a display device according to an exemplary embodiment of the invention.

Referring to FIG. 4, in a method of controlling a display device according to an exemplary embodiment of the invention, first, the driving voltage VOUT (refer to FIG. 1)

supplied to the display unit 100 feds back (S10). The driving voltage supplying unit 200 (refer to FIG. 1) supplies the driving voltage VOUT to the display unit 100 (refer to FIG. 1). The driving voltage VOUT may include at least one of a common voltage Vcom supplied to the pixel unit 140 (refer to FIG. 1) and a data driving voltage AVDD (refer to FIG. 1) provided to the data driver 120 (refer to FIG. 1). The ripple detection circuit 300 may receive a feedback of the driving voltage VOUT.

Next, the number of times a ripple of the driving voltage VOUT is generated is detected (S20). The ripple detecting circuit 300 (refer to FIG. 1) detects the number of times a ripple of the driving voltage VOUT is generated. In the exemplary embodiment, the ripple detection circuit 300 may count the number of times the ripple is generated when a size of the ripple of the driving voltage VOUT is equal to or larger than a reference level.

Particularly, it is determined whether a size of the ripple of the driving voltage VOUT is equal to or larger than a reference level (S21). The reference level of the size of the ripple may be a value predetermined according to a load characteristic of the display unit 100.

When it is determined that the size of the ripple is equal to or larger than the reference level in operation S21, the number of times the ripple of the driving voltage VOUT is generated is counted (S23). When it is determined that the size of the ripple is less than the reference level in operation S21, an operation of feeding back and monitoring the driving voltage VOUT is repeated.

Then, it is determined whether the number of times the ripple is generated is equal to or larger than a reference value (S25). The ripple detection circuit 300 may provide ripple data Rdata about the size of the ripple and the number of times the ripple is generated to the controller 400. When it is determined that the number of times the ripple is generated is less than the reference value in operation S25, an operation of feeding back and monitoring the driving voltage VOUT is repeated.

When it is determined that the number of times the ripple is generated is equal to or larger than the reference value in operation S25, the driving voltage is changed based on the number of times the ripple is generated (S30). The controller 400 may generate and output a driving voltage control signal VCS for controlling the driving voltage supply unit 200. The driving voltage supplying unit 200 may increase or decrease a voltage level of the driving voltage VOUT in response to the driving voltage control signal VCS of the controller 400 and output the driving voltage VOUT.

Figure 5:
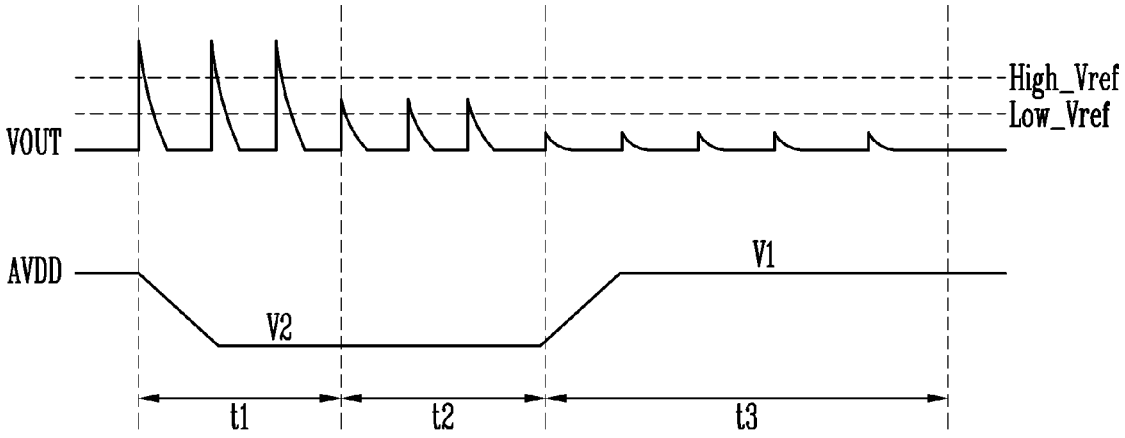
FIG. 5 is a waveform diagram for describing a ripple compensation operation of a display device according to an exemplary embodiment of the invention.

FIG. 5 is a waveform diagram for describing a ripple compensation operation of a display device according to an exemplary embodiment of the invention.

Hereinafter, an overlapping description of the substantially same configuration as that of the aforementioned exemplary embodiment will be omitted.

Referring to FIG. 5, a display device according to an exemplary embodiment of the invention determines a size of a ripple of a driving voltage VOUT by using two reference levels. Further, the display device may differently perform a ripple compensation operation according to the size of the ripple. To this end, the ripple detection circuit 300 (refer to FIG. 1) may detect the size of the ripple and the number of times the ripple is generated and provide the detected size of the ripple and the detected number of times the ripple is generated to the controller 400 (refer to FIG. 1). It is assumed that the ripple compensation operation in the illustrated exemplary embodiment changes a voltage level of a data driving voltage AVDD in the driving voltage VOUT.

Particularly, it is assumed that the driving voltage VOUT is output with a normal voltage level V1 in a general state, and when the size of the ripple is equal to or larger than a high reference level High_Vref, the controller 400 controls the driving voltage supply unit 200 (refer to FIG. 1) so as to change a voltage level of the data driving voltage AVDD to a predetermined compensation voltage level V2. Here, the compensation voltage level V2 is a voltage level for compensating for the ripple, and is set to be lower than the normal voltage level V1.

In an exemplary embodiment, when the controller 400 determines that the ripple having the size equal to or larger than the high reference level High_Vref is generated one or more times for a first period t1, the controller 400 controls the driving voltage supply unit 200 so as to decrease the data driving voltage AVDD to the compensation voltage level V2 that is a level of about 80% of the normal voltage level V1, for example. When the voltage level of the data driving voltage AVDD is decreased, the size of the ripple is also decreased.

Further, when the size of the ripple is less than the high reference level High_Vref and exceeds a low reference level Low_Vref, the controller 400 controls the driving voltage supply unit 200 so as to maintain the voltage level of the data driving voltage AVDD. Here, the low reference level Low_Vref has a value less than that of the high reference level High_Vref.

In an exemplary embodiment, it is assumed that the voltage level of the driving voltage VOUT is changed to the compensation voltage level V2 for the first period t1, and when the sizes of all of the ripples generated for a second period t2 are less than the high reference level High_Vref and exceeds the low reference level Low_Vref, the controller 400 maintains the compensation voltage level V2 without changing the voltage level of the driving voltage VOUT, for example.

Further, when the size of the ripple is equal to or less than the low reference level Low_Vref, the controller 400 may control the driving voltage supply unit 200 so as to change the voltage level of the driving voltage VOUT to the predetermined normal voltage level V1. That is, when the size of the ripple is equal to or less than a predetermined level, the controller 400 normalizes the voltage level of the driving voltage VOUT.

In an exemplary embodiment, it is assumed that the voltage level of the driving voltage VOUT is maintained with the compensation voltage level V2 for the second period t2, and when it is determined that the ripple having the size equal to or less than the low reference level Low_Vref is generated one or more times, the controller 400 controls the driving voltage supply unit 200 so as to increase the driving voltage VOUT from the compensation voltage level V2 to the normal voltage level V1, for example.

Accordingly, the display device of the illustrated exemplary embodiment may prevent the driving voltage from being excessively frequently changed according to the generation of the ripple of the driving voltage VOUT.

Figure 6:
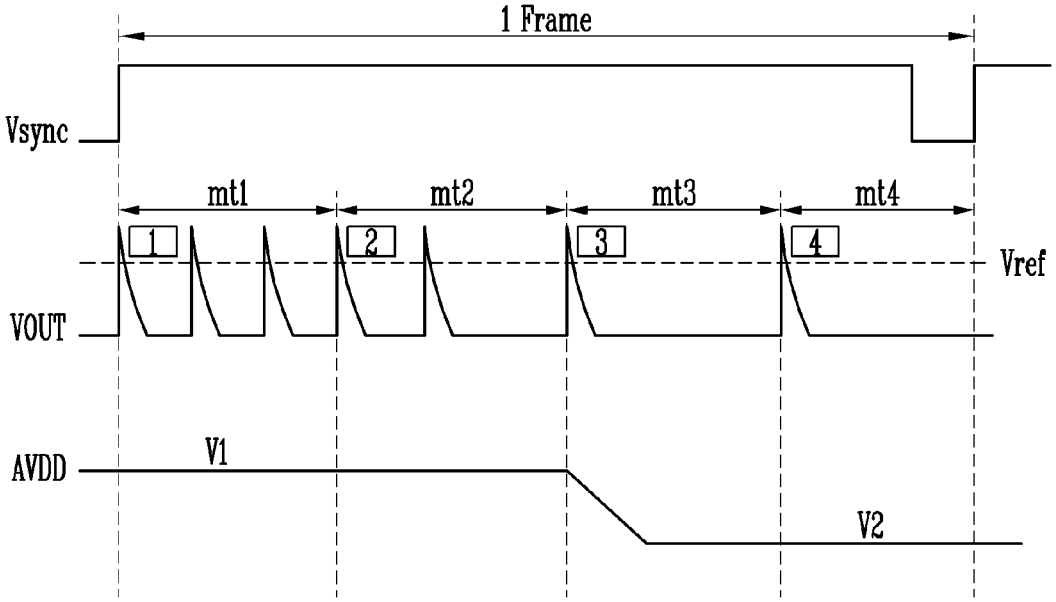
FIG. 6 is a waveform diagram for describing a ripple compensation operation of a display device according to an exemplary embodiment of the invention.

FIG. 6 is a waveform diagram for describing a ripple compensating operation of a display device according to an exemplary embodiment of the invention.

Referring to FIG. 6, a display device according to an exemplary embodiment of the invention counts the number of times a ripple is generated in a unit of a predetermined time, which is a value obtained by dividing one frame into a plurality of unit periods. That is, when a ripple is generated, a ripple compensation operation is not immediately performed, but a generation of the ripple is periodically checked in the unit of the predetermined time and the ripple compensation operation is performed. It is assumed that the ripple compensation operation in the illustrated exemplary embodiment changes a voltage level of a data driving voltage AVDD in the driving voltage VOUT.

In an exemplary embodiment, it is assumed that one frame includes a first unit period mt1, a second unit period mt2, a third unit period mt3, and a fourth unit period mt4, for example. Further, it is assumed that the ripple having a reference level Vref or more is generated three times within the first unit period mt1, the ripple having the reference level Vref or more is generated two times within the second unit period mt2, and the ripple having the reference level Vref or more is generated one time within each of the third unit period mt3 and the fourth unit period mt4. Further, it is assumed that when the ripple is continuously generated for the two unit periods, the controller 400 (refer to FIG. 1) is set to perform the ripple compensation operation.

The ripple having the reference level Vref or more is generated three times within the first unit period mt1, but the ripple detection circuit 300 (refer to FIG. 1) may count only the ripple generated at the first time and notify the counted ripple to the controller 400. Further, the ripple having the reference level Vref or more is generated two times within the second unit period mt2, but the ripple detection circuit 300 may count only the ripple generated at the first time and notify the counted ripple to the controller 400.

The controller 400 may recognize that the ripple is continuously generated in the first unit period mt1 and the second unit period mt2, and control the driving voltage supply unit 200 (refer to FIG. 1) so as to decrease the voltage level of the data driving voltage AVDD from the normal voltage level V1 to the compensation voltage level V2 from the third unit period mt3.

Accordingly, the display device of the illustrated exemplary embodiment may prevent the driving voltage from being excessively frequently changed according to the generation of the ripple of the driving voltage VOUT.

Figure 7:
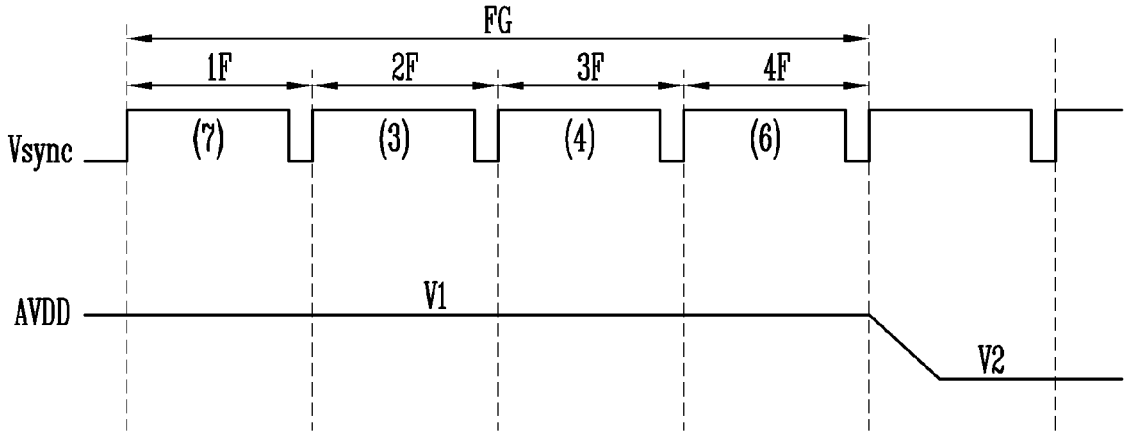
FIG. 7 is a waveform diagram for describing a ripple compensation operation of a display device according to a fourth exemplary embodiment of the invention.

FIG. 7 is a waveform diagram for describing a ripple compensating operation of a display device according to an exemplary embodiment of the invention.

Referring to FIG. 7, a display device according to an exemplary embodiment of the invention checks the number of times a ripple is generated in the unit of a frame, averages the number of times the ripple is generated corresponding to each frame for the plurality of frames and calculates the average number of times the ripple is generated, and performs a ripple compensation operation when the average number of times the ripple is generated is equal to or larger than a reference value. The number of frames for calculating the average number of times the ripple is generated and the reference value of the average number of times the ripple is generated may be preset according to a characteristic of the display unit 100 (refer to FIG. 1). It is assumed that the ripple compensation operation in the illustrated exemplary embodiment changes a voltage level of a data driving voltage AVDD in the driving voltage VOUT.

In an exemplary embodiment, it is assumed that the number of times the ripple is generated during a frame group FG that is the unit of the plural frames are averaged, and when the average number of times the ripple is generated is equal to or larger than 4, for example, the controller 400 performs the ripple compensation operation. It is assumed that the frame group FG includes a first frame 1F, a second frame 2F, a third frame 3F, and a fourth frame 4F. It is assumed that the ripple is generated seven times for the first frame 1F, the ripple is generated three times for the second frame 2F, the ripple is generated four times for the third frame 3F, and the ripple is generated six times for the fourth frame 4F.

The controller 400 recognizes that the ripple is generated a total of 20 times during the frame group FG, and calculates the average number of times the ripple is generated to five. Further, when the average number of times the ripple is generated is equal to or larger than four, the controller 400 controls the driving voltage supply unit 200 so as to decrease the voltage level of the data driving voltage AVDD from the normal voltage level V1 to the compensation voltage level V2.

Accordingly, the display device of the illustrated exemplary embodiment may prevent the driving voltage from being excessively frequently changed according to the generation of the ripple of the driving voltage VOUT. The technical spirit of the invention have been described according to the exemplary embodiment in detail, but the exemplary embodiment has described herein for purposes of illustration and does not limit the invention. Further, those skilled in the art will appreciate that various modifications may be made without departing from the scope and spirit of the invention.

What is claimed is:

1. A display device, comprising:

a display unit;

a driving voltage supply unit which supplies a driving voltage to the display unit;

a ripple detection circuit which detects a number of times a ripple of the driving voltage is generated; and a controller which controls the driving voltage supply unit so as to change the driving voltage based on the number of times the ripple is generated.

2. The display device of claim 1, wherein the ripple detection circuit counts the number of times the ripple is generated when a size of the ripple of the driving voltage is equal to or larger than a reference level.

3. The display device of claim 2, wherein when the number of times the ripple is generated for one frame is equal to or larger than a reference value, the controller controls the driving voltage supply unit so as to decrease the driving voltage.

4. The display device of claim 2, wherein the ripple detection circuit provides ripple data for the size of the ripple and the number of times the ripple is generated to the controller.

5. The display device of claim 2, wherein the controller differentially changes the driving voltage according to the size of the ripple and the number of times the ripple is generated.

6. The display device of claim 2, wherein when the size of the ripple is equal to or larger than a high reference level, the controller controls the driving voltage supply unit so as to change a voltage level of the driving voltage to a predetermined compensation voltage level, when the size of the ripple is equal to or less than a low reference level, which is less than the high reference level, the controller controls the driving voltage supply unit so as to change the voltage level of the driving voltage to a predetermined normal voltage level, and when the size of the ripple is less than the high reference level and exceeds the low reference level, the controller controls the driving voltage supply unit so as to maintain the voltage level of the driving voltage.

7. The display device of claim 6, wherein the compensation voltage level is less than the predetermined normal voltage level.

8. The display device of claim 2, wherein the ripple detection circuit counts the number of times the ripple is generated in a unit of a predetermined time which is a value obtained by dividing one frame into a plurality of unit periods.

9. The display device of claim 2, wherein the controller averages the numbers of times the ripple is generated corresponding to each frame for a plurality of frames and calculates an average number of times the ripple is generated, and when the average number of times the ripple is generated is equal to or larger than a reference value, the controller controls the driving voltage supply unit so as to decrease the driving voltage.

10. The display device of claim 1, wherein the ripple detection circuit includes:

a first comparator, which compares a positive reference voltage with the driving voltage;

a second comparator, which compares a negative reference voltage with the driving voltage;

a first counter, which counts a result value of the first comparator; and a second counter, which counts a result value of the second comparator.

11. The display device of claim 1, wherein the ripple detection circuit receives the driving voltage through a feedback line.

12. The display device of claim 1, wherein the display unit includes:

a pixel unit including a plurality of pixels connected with gate lines and data lines;

a gate driver, which supplies gate signals through the gate lines; and a data driver, which supplies data signals through the data lines.

13. The display device of claim 12, wherein the driving voltage includes at least one of a common voltage supplied to the pixel unit and a data driving voltage supplied to the data driver.

14. A method of controlling a display device, the method comprising:

supplying a driving voltage to a display unit;

detecting a number of times a ripple of the driving voltage is generated; and changing the driving voltage based on the number of times the ripple is generated.

15. The method of claim 14, wherein the detecting the number of times the ripple is generated includes counting the number of times the ripple is generated when a size of the ripple of the driving voltage is equal to or larger than a reference level.

16. The method of claim 15, wherein the changing the driving voltage includes decreasing the driving voltage when the number of times the ripple is generated for one frame is equal to or larger than a reference value.

17. The method of claim 15, wherein the changing the driving voltage includes changing a voltage level of the driving voltage to a predetermined compensation voltage level when a size of the ripple is equal to or larger than a high reference level, when the size of the ripple is equal to or less than a low reference level, which is less than the high reference level, changing the voltage level of the driving voltage to a predetermined normal voltage level, and when the size of the ripple is less than the high reference level and exceeds the low reference level, maintaining the voltage level of the driving voltage.

18. The method of claim 17, wherein the compensation voltage level is less than the predetermined normal voltage level.

19. The method of claim 18, wherein the detecting the number of times the ripple is generated includes counting the number of times the ripple is generated in a unit of a predetermined time which is a value obtained by dividing one frame into a plurality of unit periods.

20. The method of claim 18, wherein the changing the driving voltage includes averaging the numbers of times the ripple is generated corresponding to each frame for a plurality of frames and calculating an average number of times the ripple is generated, and decreasing the driving voltage when the average number of times the ripple is generated is equal to or larger than a reference value.

* * * * *